United States Patent [19]

Leih

[11] Patent Number: 4,525,701

[45] Date of Patent: Jun. 25, 1985

[54] SECURITY ALARM ARRANGEMENT

[76] Inventor: Michael P. Leih, 55, 4th Ave., Edenvale, Transvaal, South Africa, 1610

[21] Appl. No.: 411,341

[22] Filed: Aug. 25, 1982

[30] Foreign Application Priority Data

Mar. 16, 1982 [ZA] South Africa ..... 82/1747

[51] Int. Cl.[3] ..... G08B 13/12

[52] U.S. Cl. ..... 340/541; 340/668; 200/61.93; 256/10; 256/32

[58] Field of Search ..... 340/541, 668, 666; 256/32, 12, 10, 11; 200/61.93, 276

[56] References Cited

U.S. PATENT DOCUMENTS 697,259 4/1902 Lavely ..... 256/32
3,504,892 4/1970 Crist ..... 256/10
3,778,805 12/1973 Gould ..... 340/541
4,041,265 8/1977 Brave et al. ..... 340/541 X
4,196,890 4/1980 Einhorn ..... 256/10 X

FOREIGN PATENT DOCUMENTS 938853 7/1982 U.S.S.R. ..... 256/32

*Primary Examiner*—James L. Rowland
*Assistant Examiner*—Thomas J. Mullen, Jr.
*Attorney, Agent, or Firm*—Brumbaugh, Graves, Donohue & Raymond

[57] ABSTRACT

This invention relates to a security alarm arrangement which embodies a substantially helically extending deterrent wire generally of a coiled configuration. At least one longitudinally extending electrically conductive wire passes through the helical wire configuration in the general direction of the axis thereof. The helical wire configuration and the longitudinally extending wire are both connected to an alarm system which will trigger should the two wires be brought into contact.

7 Claims, 1 Drawing Figure

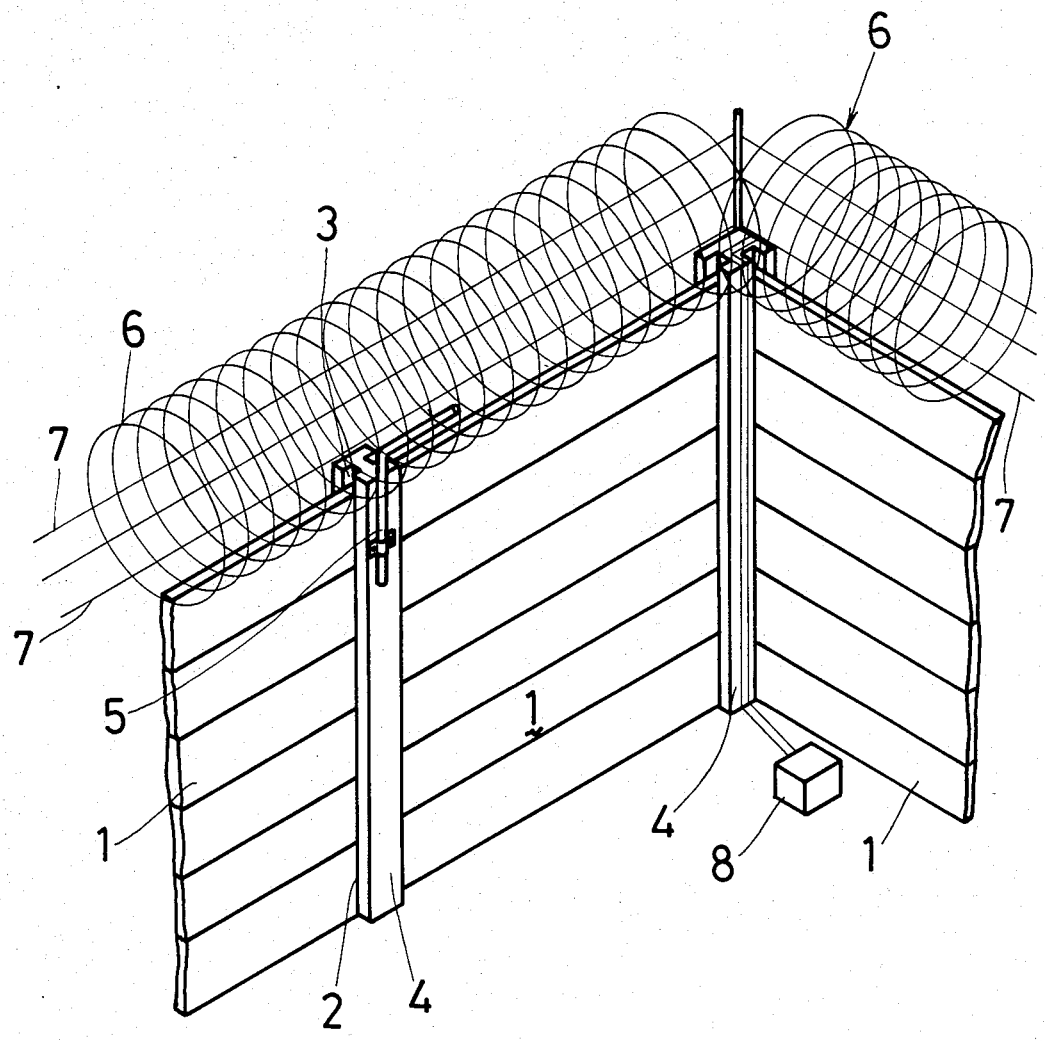
6
3
6
7
7
7
5
1
1
4
8
1
2
4

SECURITY ALARM ARRANGEMENT

BACKGROUND TO THE INVENTION

This invention relates to a security alarm arrangement and, more particularly, to a security alarm arrangement embodying a substantially helically extending deterrent wire generally of a coiled configuration.

Coiled deterrent wires which are usually of a barbed wire tape configuration having sharp spikes extending therefrom, are widely used as deterrents around property to be protected against unauthorised entry. Such deterrent wires can be used at ground level, in combination with a security fence at either ground level or a raised position and, in particular, along the top of a security fence which is generally alarmed.

Such deterrent wires do, however, not absolutely prevent unauthorised entry as they can indeed be cut to provide an entry passage therethrough.

For this reason such deterrent wires are normally used in combination with an alarmed fence on the basis that the fence alarm will provide a warning should the deterrent wires be the subject of interference by unauthorised persons.

It is the object of this invention to provide a more practical and simple alarm arrangement in combination with a deterrent wire of the above described type which will, it is envisaged, provide a more easily triggered alarm situation in the event of interference with the deterrent wire.

BRIEF SUMMARY OF THE INVENTION

In accordance with this invention there is provided a security installation including a deterrent wire arranged to substantially describe a hollow cylinder in general configuration and at least one electrically conductive wire passing through the cylindrical deterrent wire in the general direction of the axis thereof, the longitudinally extending wire and deterrent wire being connected to an alarm system such that any contact between the two triggers the alarm system.

Further features of the invention provide for the longitudinally extending wire to be at potential different from earth in which case the deterrent wire can be at earth potential and for there to be a plurality of longitudinally extending wires which may be parallel to somewhat criss-crossed but extending generally in the axial direction.

It is a particular feature of the invention that a deterrent wire according to the invention, together with its longitudinally extending wire positioned within the helical or coiled configuration, be used to protect the upper edge of a fence or wall. It will be understood that it would be extremely difficult, if at all possible, to sever the deterrent wire without it springing into some form or another which would cause one of the longitudinally extending wire to be contacted at least momentarily. Such momentary contact is adapted to trigger the alarm system in each case.

BRIEF DESCRIPTION OF THE DRAWINGS

In order that the invention may be more fully understood one embodiment thereof will now be described with reference to the accompanying drawing which is an isometric view of a portion of a precast wall having a deterrent wire arrangement according to the invention extending along the upper edge thereof.

DETAILED DESCRIPTION WITH REFERENCE TO THE DRAWINGS

In this particular embodiment of the invention the wall is of a precast type composed of a series of panels 1 located in vertically stacked orientation relative to each other and with their ends 2 located in grooves 3 provided in vertically extending posts 4.

This is a standard type of precast wall construction but, the wall is protected by an alarm system composed of conductive wires (not shown) either located within the panels or adhesively secured to the outside thereof and which are adapted to be fractured in the event that a panel is broken or moved sufficiently to enable a person to pass through the wall.

In order to protect the upper edge of the wall however, an arrangement according to the present invention is attached thereto.

This arrangement consists of a plurality of brackets 5 which are employed for supporting a helically wound coil of deterrent wire which may assume the form either of barbed wire is barbed tape 6. The helical configuration is simply obtained by drawing out axially a roll of such barbed tape or wire so that it assumes the helical configuration and, in this condition, it is under an appreciable amount of resilient strain. The brackets 5 fix the helical configuration sufficiently rigidly to the wall to ensure that only minimal transverse movement of the helical configuration is ordinarily possible.

As shown clearly in the figure, a series of, in this case three, longitudinally extending wires 7 are passed through the deterrent wire in the general direction of the axis thereof. All three wires are electrically conductive and connected to a security alarm system generally indicated by numeral 8. In like manner the deterrent wire is also electrically conductive and is connected, possibly by way of the earth, to the security alarm system.

The longitudinally extending wires are subjected to appreciable tension in their operative position and, as a result, if either the longitudinally extending wires or the deterrent wire are cut, the natural resilience of the wire will cause them to move rapidly in any and all directions so that contact between the two wires, albeit momentary, is inevitable.

Such contact is adapted to cause triggering of the alarm system and thereby to indicate an alarm condition.

It will be understood that the above described embodiment of the invention can be applied to helically wound or other similar deterrent wires which describe in general configuration a cylinder through which the conductive longitudinally extending wires can pass.

It is envisaged that the invention will provide a most useful yet simple security alarm arrangement for use in conjunction with fences, walls and the like or simply for use in conjunction with deterrent wires themselves.

What I claim as new and desire to secure by Letters Patent is:

1. A security installation including a deterrent wire arranged to substantially describe a hollow cylinder in general configuration and at least one longitudinally extending, electrically conductive wire passing through the cylindrical deterrent wire in the general direction of the axis thereof, the longitudinally extending wire and deterrent wire being connected to an alarm system such that any contact between the two triggers the alarm system.

2. A security installation as claimed in claim 1 wherein the longitudinally extending wire is at a potential different from earth.

3. A security installation as claimed in claim 2 wherein the deterrent wire is at earth potential.

4. A security installation as claimed in any preceding claim wherein there are a plurality of longitudinally extending wires which extend in generally the axial direction of the cylindrical deterrent wire.

5. A security installation as claimed in any one of claims 1 to 3 wherein the longitudinally extending wire positioned within the cylindrical deterrent wire configuration is located on the upper edge of a fence or wall.

6. A security installation as claimed in claim 5 in which the cylindrical configuration of the deterrent wire is formed by coiled wire.

7. A security installation as claimed in claim 1 wherein the deterrent wire comprises barbed wire.

* * * * *